United States Patent [19]

Russo

[11] Patent Number: 5,033,149

[45] Date of Patent: Jul. 23, 1991

[54] SWIMMING POOL CLEANING APPARATUS

[76] Inventor: William V. Russo, 2624 Mayfield Ave., La Crescenta, Calif. 91214

[21] Appl. No.: 427,467

[22] Filed: Oct. 26, 1989

[51] Int. Cl.[5] ..... E04H 4/16

[52] U.S. Cl. ..... 15/1.7; 15/415.1; 15/418

[58] Field of Search ..... 15/1.7, 246.5, 415 A, 15/415 R, 418, 417, 358, 357, 359, 246; 4/290

[56] References Cited

U.S. PATENT DOCUMENTS

| | | | |
|---|---|---|---|
| 3,074,087 | 1/1963 | Drennan | 15/1.7 |
| 3,243,830 | 4/1966 | Conrad | 15/1.7 |
| 3,273,188 | 9/1966 | Levack | 15/415 R |
| 3,509,589 | 5/1970 | Bond | 15/415 R |
| 3,805,309 | 4/1974 | Levack | 15/415 R |
| 3,940,817 | 3/1976 | Levack | 15/415 R |
| 3,949,442 | 4/1976 | Chandler | 15/415 R |
| 4,376,320 | 3/1983 | Linda | 15/1.7 |
| 4,402,101 | 9/1983 | Van Zyl | 15/1.7 |
| 4,502,172 | 3/1985 | Chandler | 15/1.7 |
| 4,637,086 | 1/1987 | Goode | 15/415 R |
| 4,776,053 | 10/1988 | Kiraly | 15/246 X |
| 4,835,810 | 6/1989 | Hugo | 15/1.7 |

*Primary Examiner*—Philip R. Coe
*Assistant Examiner*—C. Cooley
*Attorney, Agent, or Firm*—James E. Brunton

[57] ABSTRACT

A swimming pool vacuum cleaning apparatus having a flexible platform, including an apertured central portion adapted for interconnection with a suction line, a pair of outboard roller assemblies for maintaining the end portions of the platform in a spaced relationship with the pad bottom and a pair of inboard roller assemblies which are readily vertically adjustable relative to the platform so that the spacing between the central, suction portion of the platform and the pool bottom can be quickly and easily adjusted during the pool cleaning operation. The inboard roller assemblies as individual units can also readily be attached to certain types of existing cleaning apparatus to provide an improved vertical adjustment feature.

5 Claims, 3 Drawing Sheets

FIG. 1
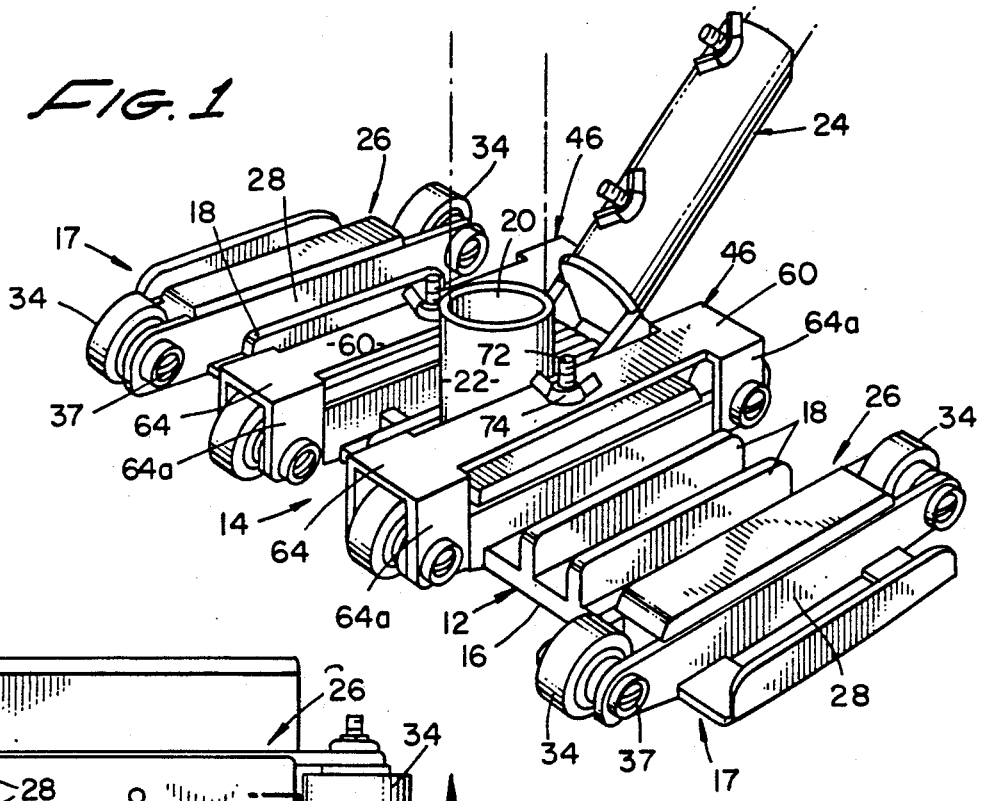
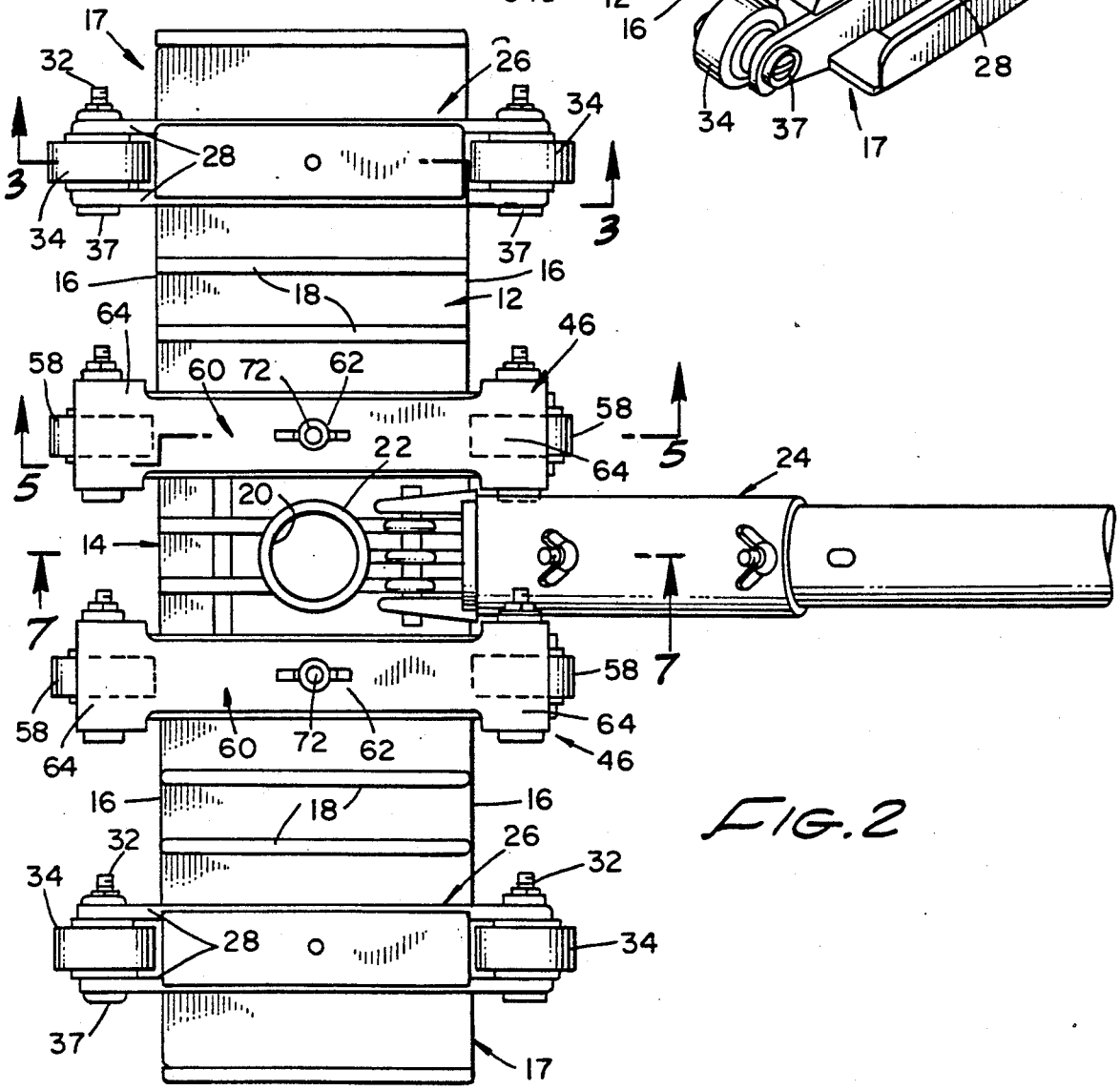
FIG. 2

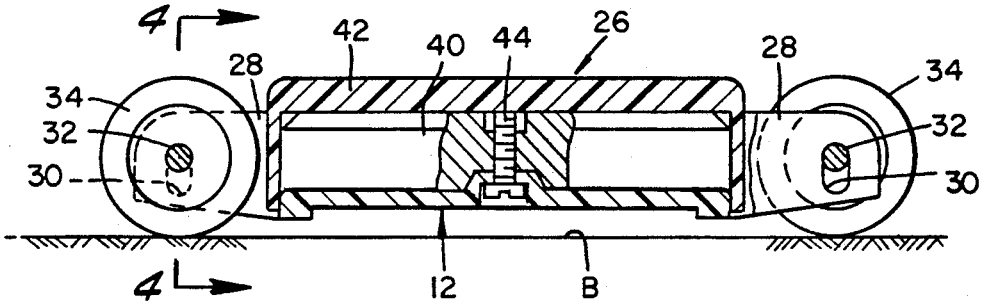
FIG. 3
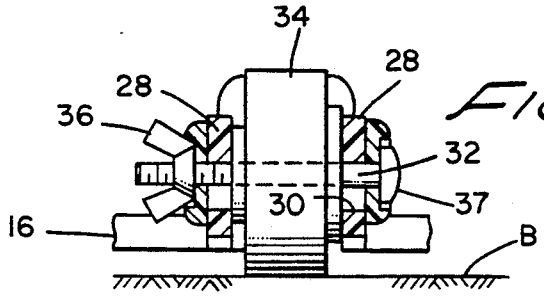
FIG. 4
FIG. 5
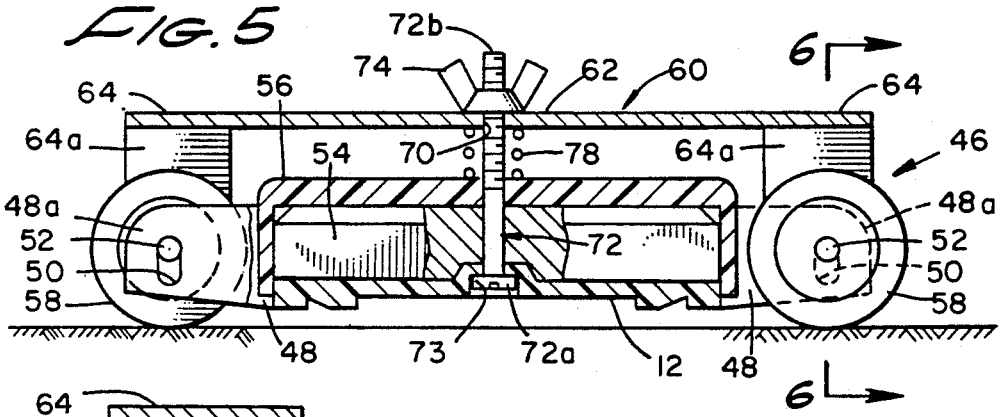
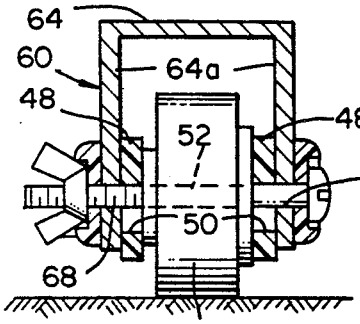
FIG. 6
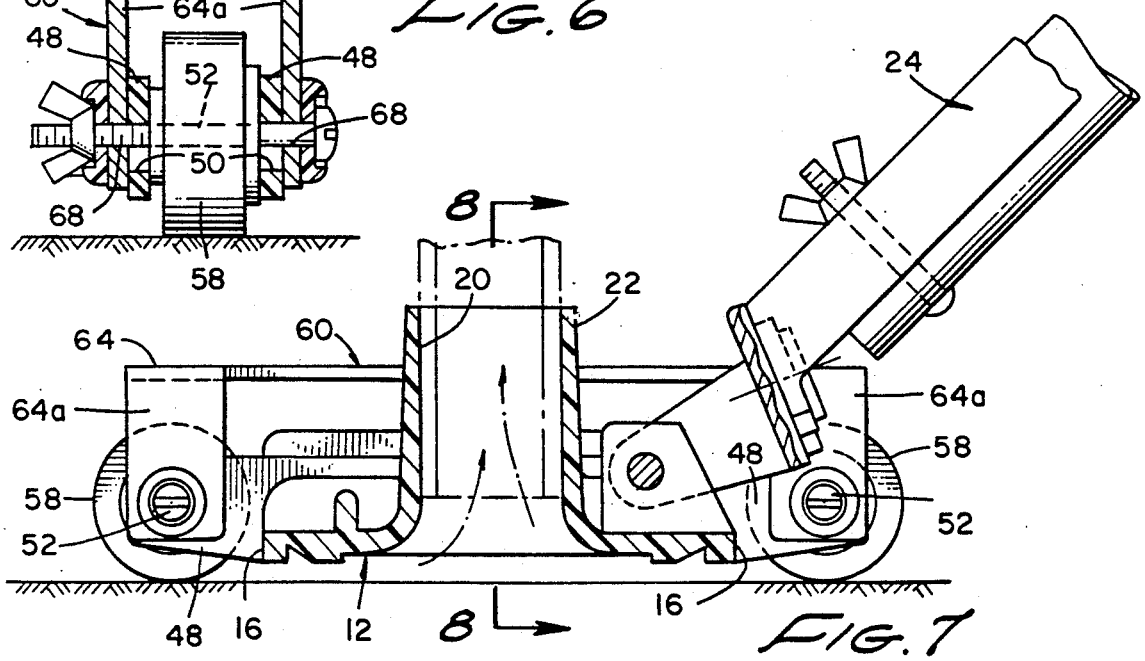
FIG. 7

17
26
28
40
42
44
34
32
18
12
60
78
64a
72b
56
48
72a
58
73
74
20
70
72
54
22
14

-24-
-54-
-22-
64a
52
58
56
22
78
73
72a
72b
74
62
12
60
64
46
50

10
10
17
26
40
28
42
44
34
32
12
18
46
60
74
48
58
54
64a
56
20
B
14
78

SWIMMING POOL CLEANING APPARATUS

BACKGROUND OF THE INVENTION

1. Field of the Invention

The present invention relates generally to swimming pool vacuum cleaning devices. More particularly, the invention concerns a swimming pool vacuum cleaning apparatus having a flexible platform the central, vacuum portion of which is readily adjustable relative to the pool bottom to enable precise regulation of suction efficiency during the pool cleaning operation.

DISCUSSION OF THE INVENTION

2. Introduction

Several types of devices have been suggested for cleaning swimming pools using a suction source such as the pool circulation pump. Typically, these prior art devices include a suction head which is connected to a flexible suction line and then moved manually across the pool bottom using an elongated handle which is connected to the suction head. Devices of the aforementioned character are described in U.S. Pat. Nos. 3,805,309 issued to Levack; 4,402,101 issued to van Zyl; and 4,637,086 issued to Goode.

A drawback of many of the prior art devices resides in the fact that there is no expeditious way to regulate the suction being exerted by the device during the cleaning operation. Because the suction pressure available varies widely from pool to pool there is a real need to have a simple adjustment on the vacuum head itself to enable real time adjustment of the suction being exerted by the vacuum head without having to adjust the vacuum at the circulation pump. As will be appreciated from the discussion which follows, the apparatus of the present invention overcomes the drawbacks of the prior art by providing an adjustment on the vacuum head itself which enables the quick and easy regulation of the amount of suction being exerted by the suction head.

In the device of the preferred form of the invention, the suction adjustment is accomplished using conveniently located adjustment mechanisms provided on the top of the suction head. These adjustment mechanisms precisely regulate the spacing between the lower surface of the central, suction portion of the suction head and the bottom of the pool.

In the devices of the previously identified U.S. Pat. Nos. 4,402,101 and 4,637,086, adjustment of the spacing between the suction head and the pool bottom can be done by separately adjusting the position of each of the rollers with respect to the base or platform of the device. However, such adjustments are difficult and time consuming and are of little value to commercial pool cleaning operators who must use the vacuum head for continuous cleaning of a number of pools having suction sources of widely varying capabilities.

With respect to devices of the general character described in U.S. Pat. No. 4,637,086 wherein the individual wheel carrying axles of the wheel assemblies use movable upwardly and downwardly within slots provided in outwardly extending rib sections, the adjustment means of the present invention can frequently be added to the existing devices with relatively minor changes to the device being required. This aspect of the present invention will be discussed in greater detail in the paragraphs which follow.

SUMMARY OF THE INVENTION

It is an object of the present invention to provide a swimming pool vacuum cleaner in which the vacuum head can be readily adjusted with respect to the pool bottom so that the effective suction being exerted by the suction head can be easily regulated on a real time basis during the pool cleaning operation.

Another object of the invention is to provide a pool cleaner of the aforementioned character in which the adjustment mechanisms are conveniently located on the top of the vacuum head and can be quickly operated by hand without the need for hand tools.

Another object of the invention is to provide a pool cleaner of the character described in the preceding paragraphs in which the suction exerted by the vacuum head can be precisely regulated without the need for regulation of the remotely located suction source.

Still another object of the invention is to provide adjustment mechanisms in kit form which can be interconnected with certain types of existing, prior art pool cleaning devices without the need for major retrofit of the existing devices.

A further object of the invention is to provide an adjustment mechanism of the aforementioned character which is simple and easy to use, easy to connect to existent devices and one which can be manufactured very inexpensively.

BRIEF DESCRIPTION OF THE DRAWINGS

FIG. 1 is a generally perspective view of the adjustable pool vacuum head of the present invention.

FIG. 2 is an enlarged top plan view of the apparatus of the invention.

FIG. 3 is a cross sectional view taken along lines 3—3 of FIG. 2.

FIG. 4 is a cross sectional view taken along lines 4—4 of FIG. 3.

FIG. 5 is a cross sectional view taken along lines 5—5 of FIG. 2.

FIG. 6 is a cross sectional view taken along lines 6—6 of FIG. 5.

FIG. 7 is a cross sectional view taken along lines 7—7 of FIG. 2.

DESCRIPTION OF THE INVENTION

Figure 8:
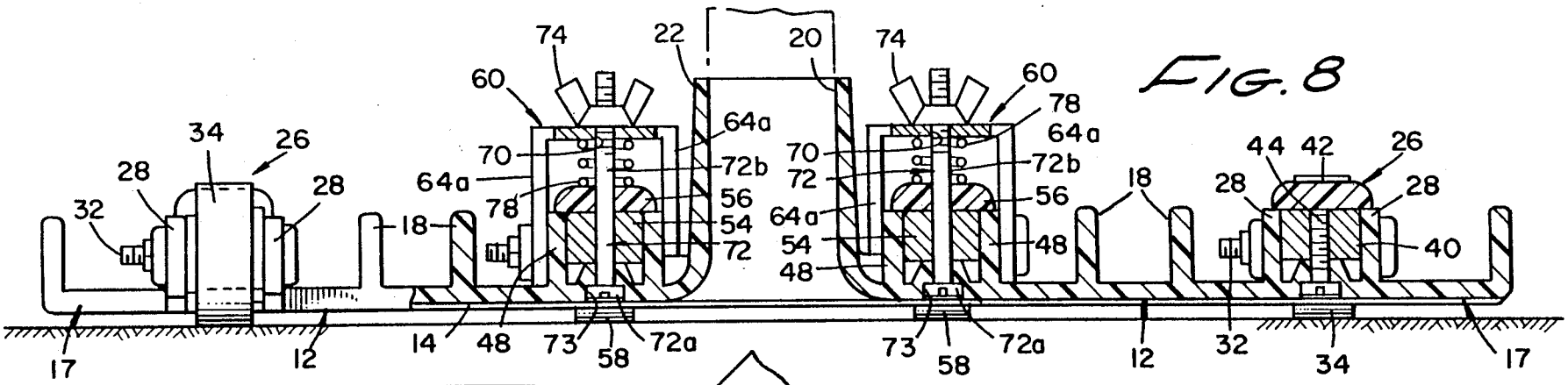
FIG. 8 is a cross sectional view taken along lines 8—8 of FIG. 7.

Referring to the drawings and particularly to FIGS. 1 through 3, the suction head assembly of the present invention comprises a generally rectangular, horizontally extending platform 12 having a central portion 14, longitudinally extending edges 16, longitudinally spaced end portions 17 and a plurality of longitudinally spaced, transverse stiffening ribs 18. The central portion of platform 12 is provided with an opening 20 and an upwardly extending cylindrical member 22 in communication with opening 20. As indicated by the phantom lines in FIGS. 1 and 7, cylindrical member 22 is adapted for interconnection with a flexible suction line which, in turn, is interconnected with a source of suction such as the pool circulation pump. A handle assembly 24 of standard construction is pivotally interconnected with platform 12 proximate the center portion 14 thereof and is used for moving the suction head across the bottom of the pool. The platform 12 and cylindrical member 22 are preferably integrally formed from a yieldably deformable plastic material.

A first, or outboard roller assembly 26 is connected to to platform 12 proximate each end portion 17 thereof. In the instant form of the invention, each outboard roller assembly 26 comprises a pair of spaced apart ribs, or walls 28, the end portions of which extend outwardly from the longitudinally extending edges 16 of the platform. As best seen in FIG. 3, each end portion of each rib member 28 is provided with a vertically extending slot 30. An axle 32 spans the adjacent walls 28 and is vertically movable within slots 30. Axles 32 function to rotatably support rollers 34, which, as shown in FIGS. 3 and 4, are adapted to engage the pool bottom B. Each axle 32 is threaded at one end to threadably receive a wing nut 36 and is provided at its other end with a head 37. By tightening and loosening wing nut 36 relative to walls 28 each axle 30 can be vertically adjusted within slots 30. In this way, the vertical height of the rollers 34 can be adjusted relative to platform 12, thereby adjusting the spacing between the pool bottom and the outboard end portions 16 of the platform 12. As will be discussed in greater detail hereinafter, adjustment of the end portions of the platform is rarely necessary because of the novel adjustability feature of the central, suction portion of the platform, the details of which will presently be described. Also, forming a part of the outboard wheel assemblies 26, is an elongated lead weight 40 and a cover 42 which is interconnected with platform 12 by a threaded connector 44 (FIG. 3).

An important aspect of the apparatus of the present invention is the second, or inboard roller assemblies 46 which are interconnected with platform 12 on either side of central opening 20. As best seen by referring to FIG. 5, the construction of the inboard roller assemblies 46 is somewhat similar to the construction of the outboard roller assemblies just described. For example, each of the outboard roller assemblies includes a weight housing having spaced apart ribs, or walls 48 (FIG. 8), each of which has an end portion **48*a* which extends outwardly from edges 16 of platform 12. Each end portion 48*a* is provided with a vertical slot 50 adapted to closely receive an axle member 52 which rotatably carries a roller 58 intermediate space member 52 which rotatably carries a roller 58 intermediate space apart end portions 48*a*. Each of the inboard roller assemblies 46 also includes a weight 54 and a cover 56 which is superimposed over weight 54**.

A highly novel feature of the apparatus of the present invention resides in a specially configured frame member 60 which is connected to and spans platform 12 in the manner best seen in FIGS. 2 and 5. Each frame member 60 has a central portion 62 and spaced end portions 64 which extend outwardly on either side of longitudinally extending edges 16 of platform 12. As indicated in FIGS. 1 and 6, each end portion 64 of each frame member 60 includes downwardly extending, spaced apart legs **64*a*, each of which is provided with an aperture 68 adapted to closely receive the ends of axles 52. Legs 64*a* are closely receivable over walls 48 in the manner shown in FIG. 8. Frame members 60** can be constructed of metal, rigid plastic or any suitable, durable material.

Figure 10:
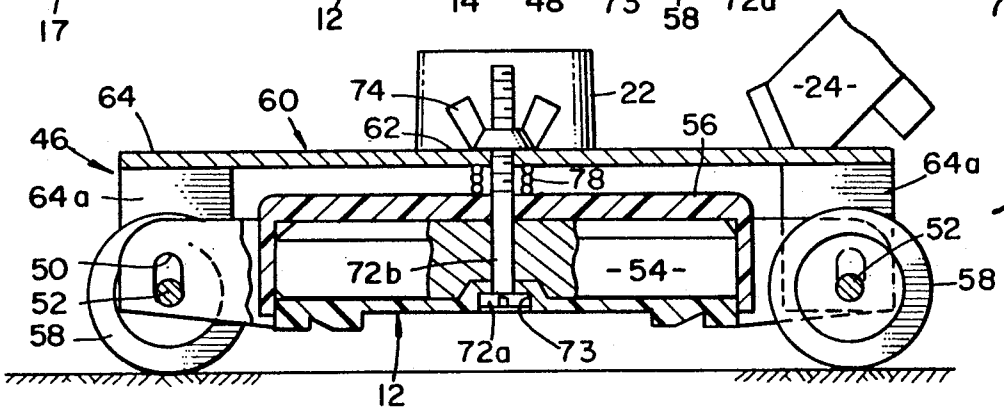
FIG. 10 is a cross sectional view taken along lines 10—10 of FIG. 9.
Figure 9:
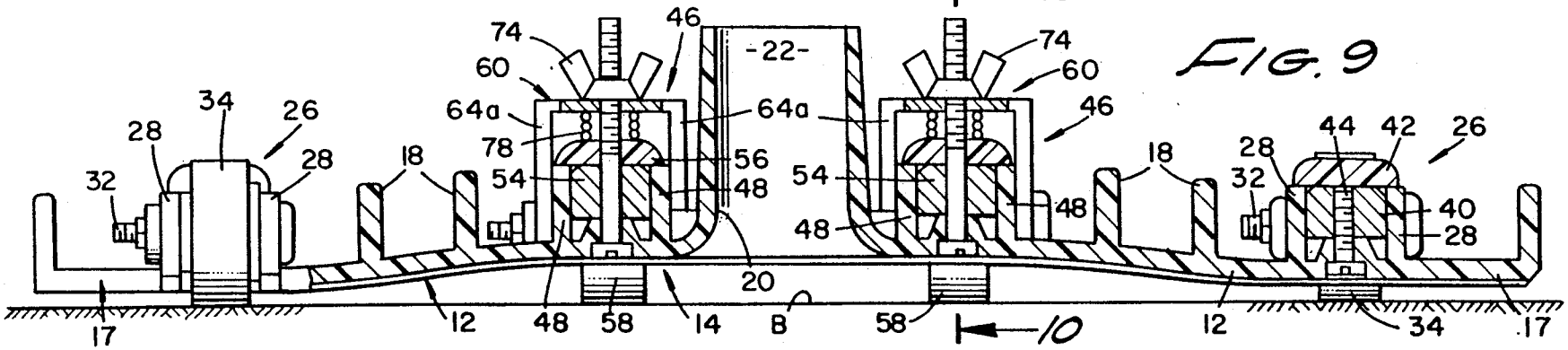
FIG. 9 is a cross sectional view similar to FIG. 8, but illustrating the adjustability of the device to raise the suction portion thereof a greater distance above the bottom of the pool surface.

The central potion 62 of each frame member 60 is provided with an aperture 70 (FIG. 8) which is adapted to closely receive a connector means, shown here as an elongate connector 72 which comprises a part of the adjustment means of the invention. As indicated in FIG. 8, connector 72 has a head portion **72*a* which is received in a counter bore 73 provided in platform 12 and a threaded shank portion 72*b*. Shank portion 72*b* is received through an aperture provided in each weight 54 and in each cover 56. The upper end of each connector 72 extends through the apertures 70 of the frame members 60 for interconnection with a wing nut 74 which can be threaded downwardly into engagement with the upper surface of each frame member 60 in the manner shown in FIG. 8. By tightening the wing nuts 74 against the upper surface of each frame member 60, each axle 52 will be caused to move downwardly within slots 50 from a first position shown in FIG. 5 to a second position shown in FIG. 10. This downward movement of axles 52 lowers the wheels 58 relative to platform 12 from the position shown in FIG. 8 to the position shown in FIG. 10. Lowering of wheels 58 causes an upward deformation of platform 12 in the manner shown in FIG. 9 so as to increase the spacing between the central, suction portion of the platform 12** and the pool bottom B.

Disposed intermediate the inner surface of each frame member 60 and the top surface of each cover 56 is a biasing means shown here as a coil spring 78. Coil spring 78 functions to yieldably resist downward movement of frame 60 from the position shown in FIG. 5 wherein the spring is expanded to the lowered position shown in FIG. 10 wherein the spring is compressed. It is apparent that by raising and lowering the rollers in the manner described to vary the spacing between the central, suction portion of the platform the effective suction of the device can be precisely regulated without having to adjust the suction at the suction source.

As previously mentioned another aspect of the present invention is a roller height adjustment device which can be provided in kit form for use in combination with certain types of prior art suction head assemblies. More particularly, the roller height adjustment device of the invention is usable in combination with a suction head assembly for sweeping a swimming pool using a section line connected to a source of suction of the character having a generally horizontally extending platform having a central portion longitudinally extending edges, and longitudinally spaced end portions, the end portions having an opening therethrough adapted for connection with the suction line. The suction head assembly must also have a first roller assembly connected to the platform proximate each end portion thereof with each roller assembly comprising at least two rollers adapted to maintain the end portions of the platform in a spaced relationship with respect to the bottom of the swimming pool. Finally, the suction head assembly must have a roller construction disposed on either side of the opening in the central portion of the platform with each roller construction including a housing connected to the platform having spaced apart walls including end portions having vertical slots formed therein and a pair of axles received within the vertical slots for rotatably carrying a pair of rollers for rotation about the axle between the end portions of the spaced apart walls. Preferably the roller construction of the existing suction head assembly will also have a lead weight disposed intermediate the walls of the housing, a cover member superimposed over the lead weight and a threaded connector for interconnecting the cover member with the platform of the suction head. Such a construction is shown in the right hand portion of FIG. 8 wherein the weight is designated by the numeral 40, the cover is designated by the numeral 42 and the threaded connector is designated by the numeral 44.

With a suction head assembly of the aforementioned character, the roller height adjustment device of the present invention can readily be assembled to the suction head assembly with minimum modification thereto. More particularly, the roller height adjustment device of the invention comprises a pair of frames 60 adapted to be positioned over the walls of the housing of the roller construction so as to span the platform in the manner shown in FIG. 2. Each frame 60 is of a construction previously described herein and includes transversely spaced end portions 64*a* each having an aperture 68 therethrough of the character shown in FIG. 6. Apertures 68 are adapted to closely receive the axles of the roller construction of the device so that an axle such as an axle 52 will extend through aperture 68 provided in frame 60 as well as through the vertical slots provided in the end portions of the spaced apart walls of the roller construction of the device. In some instances it may be necessary to replace the axles of the existing suction head with slightly longer axles.

The roller height adjustment device of the present form of the invention further comprises connector means for connecting each frame 60 to the platform of the existing device and adjustment means associated with each frame 60 for vertically adjusting the axle of each roller construction within the slots provided in the end portion of the walls of the housings of the roller constructions. In the form of the invention shown in the drawings, the connector means is provided in the form of an elongated connector such as that previously described and identified in the drawings by the numeral 72. This elongated connector includes a threaded shank portion 72 and a head portion 73. The connector is of the same general configuration as the connector used in the existing device to maintain the cover in position over the weight and the housing. However, the connector 72 is slightly longer so that the threaded upper end thereof will protrude through the central aperture provided in the frame member 60 in the manner shown in FIG. 8.

The adjustment means of this form of the invention comprises a wing nut, such as that previously described and identified by the numeral 74, which can be threadably received over the upper threaded end of the shank portion of the connector 72. The adjustment means of the invention also includes a coil spring, such as that previously identified by the numeral 60, which is adapted to be disposed intermediate the lower surface of frame 60 member and the cover 42 of the existing suction head.

The roller height adjustment device of the present invention, when sold in kit form, comprises a frame such as frame 60, an elongated connector such as connector 72, a wing nut such as wing nut 74, a coil spring such as coil spring 72 and four axles such as axles 52. Assembly of the adjustment device of the invention to an existing unit is quite simple and involves the following steps. First, the existing connector such as a connector 44 is disconnected from the closure cap which secures the weight in position within the housing of the roller construction. The cover and weight are then removed and the replacement connector element 72 is inserted through the weight in the manner shown in FIG. 8 with the head of the connector being disposed within the counter bore provided in the platform of the suction head. If necessary, the cover, such as cover 42, is then drilled out to receive the shank portion of the connector 72. Next, each of the axles of the inboard roller constructions of the existing device is removed from the vertically slotted spaced apart walls. With the axles removed and the connector element 72 in place, the coil spring is placed over the shank portion of the connector. This done, the frame 60 can be placed over the spaced apart walls, such as walls 48, so that the apertures in the downwardly extending legs thereof align with the slots in the wall portions of the existing device. As the frames 60 are implaced over the walls 48, the upper end of the connector 72 is inserted through the aperture 70 provided in the central portion of each frame 60. With the frame 60 thusly in position, each of the axles 52 can be inserted through the apertures provided in the downwardly extending leg portions of the frame member 60 and through the vertical slots provided in the side walls of the inboard roller construction of the existing device. The wing nuts 74 can then be threaded over the upper end of shank 72*b*, thereby completing the retrofit of the existing suction head assembly. With the frames 60 thusly positioned, precise adjustment of the inboard rollers relative to the platform can be accomplished in the manner previously described herein.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A suction head assembly for sweeping a swimming pool bottom using a suction line connected to a source of suction, said assembly comprising;

(a) a generally horizontally extending platform having a central portion, longitudinally extending edges and longitudinally spaced end portions, said central portion having an opening therethrough adapted for connection with the suction line;

(b) a first assembly connected to said platform proximate each said end portion thereof, each said assembly comprising at least two rollers adapted to maintain said end portion of said platform in a spaced relationship with respect to the swimming pool bottom;

(c) a second assembly connected to said platform on either side of said opening in said central portion, each said second assembly comprising:

(i) a frame adjustably connected to and spanning said platform, said frame having a central portion provided with an aperture therethrough and transversely spaced end portions extending outwardly on either said of said longitudinally extending edges of said platform;

(ii) a roller assembly rotatably carried by each said end portion of said frame, sadi roller assembly including rollers adapted to engage the pool bottom; and (iii) adjustment means connected to said platform for vertically adjusting said platform relative to said rollers of each said roller assembly, whereby the spacing between said central portion of said platform and the bottom of the pool can be adjusted, said adjustment means comprising:

A. a threaded connector having a first end connected to said central portion of said platform and a second end extending through the aperture in said frame; and B. an adjustment nut threadably interconnected with said second end of said threaded connector for engagement with said frame to adjust said platform relative to said frame.

2. A suction head assembly as defined in claim 1 further including biasing means disposed intermediate said frame and said platform for yieldably resisting relative movement between said frame and said platform.

3. A roller height adjustment device for use in combination with a suction head assembly for sweeping a swimming pool bottom using a suction line connected to a source of suction of the character having a generally horizontally extending platform having a central portion, longitudinally extending edges and longitudinally spaced end portions, said central portion having an opening therethrough adapted for connection with the suction line, a first roller assembly connected to said platform proximate each said end portion thereof, each said roller assembly comprising at least two rollers adapted to maintain said end portions of said platform in a spaced relationship with respect to the swimming pool bottom, and a roller construction disposed on either side of said opening in said central portion, each said roller construction including a housing connected to said platform having spaced apart walls including end portions having a vertical slots formed therein, a pair of axles receivable within said vertical slots and a pair of rollers rotatably carried by said axles, said roller height adjustment device comprising:

(a) a pair of frames adapted to be positioned over said walls of said housing of said roller constructions so as to span said platform, each said frame including a central portion having an aperture therein and transversely spaced end portions extending outwardly from said platform, each said end portion having an aperture therethrough adapted to receive one of said axles of said roller construction;

(b) connector means for connecting each said frame to said platform; and (c) adjustment means associated with each said frame for causing said platform to vertically transverse said axles of each of said roller constructions by means of slots provided in said end portions of said walls of said housings.

4. A roller height adjustment device as defined in claim 3 in which said connector means comprises a threaded connector having one end connected to said platform and the other end extending through said aperture in said central portion of said frame.

5. A roller height adjustment device as defined in claim 4 in which said adjustment means comprises a nut, threadably connected to said threaded connector, for engagement with said frame.

* * * * *